US010041150B2

(12) United States Patent
Gudipati et al.

(10) Patent No.: US 10,041,150 B2
(45) Date of Patent: Aug. 7, 2018

(54) BETA TITANIUM ALLOY SHEET FOR ELEVATED TEMPERATURE APPLICATIONS

(71) Applicant: Titanium Metals Corporation, Exton, PA (US)

(72) Inventors: Phani Gudipati, Henderson, NV (US); Yoji Kosaka, Henderson, NV (US)

(73) Assignee: Titanium Metals Corporation, Exton, PA (US)

( * ) Notice: Subject to any disclaimer, the term of this patent is extended or adjusted under 35 U.S.C. 154(b) by 326 days.

(21) Appl. No.: 14/703,297

(22) Filed: May 4, 2015

(65) Prior Publication Data

US 2016/0326612 A1 Nov. 10, 2016

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22F 1/183; C22C 1/0458; C22C 14/00; C22C 49/11
USPC ..... 148/421, 669–671, 505; 420/417–421
See application file for complete search history.

(56) References Cited

U.S. PATENT DOCUMENTS

| | | | |
|---|---|---|---|
| 3,619,184 | A | 11/1971 | Bomberger, Jr. |
| 3,756,810 | A | 9/1973 | Parris et al. |
| 4,087,292 | A | 5/1978 | Neal et al. |
| 4,738,822 | A | 4/1988 | Bania |
| 4,980,127 | A | 12/1990 | Parris et al. |
| 5,124,121 | A | 6/1992 | Ogawa et al. |
| 7,910,052 | B2 | 3/2011 | Matsumoto |

FOREIGN PATENT DOCUMENTS

| | | |
|---|---|---|
| EP | 0396338 | 11/1990 |

OTHER PUBLICATIONS

H. E. et al.; "Solution 1500°-1550° F. 816°-843° C. Temperature Air Cool Equivalent Air Cool Equivalent Solution Time 3-30 min 3-30 min Age Temperature 950° -1275° F. 510°-679° C. Age Time 8-16 hrs 8-16 hrs 0 0 0° F. (538° C.) for 8 hrs" (Jan. 1, 2000); XP055301740, Retrieved from the internet: URL:http:///www.timet.com/images/document/datasheets/metastablebetaalloys/21S.pdf. [retrieved on Sep. 12, 2016].
ISRWO of PCT/US2016/030552 dated Sep. 12, 2016.

*Primary Examiner* — Lois Zheng
(74) *Attorney, Agent, or Firm* — Burris Law, PLLC

(57) ABSTRACT

A cold rollable beta titanium alloy is provided by the present disclosure that exhibits excellent tensile strength, and creep and oxidation resistance at elevated temperatures. In one form, the beta titanium alloy includes molybdenum in an amount ranging between 13.0 wt. % to 20.0 wt. %, niobium between 2.0 wt. % to 4.0 wt. %, silicon between 0.1 wt. % to 0.4 wt. %, aluminum between 3.0 wt. % to 5.0 wt. %, at least one of: zirconium up to 3.0 wt. % and tin up to 5.0 wt. %, oxygen up to 0.25 wt. %, and a balance of titanium and incidental impurities. Additionally, the ranges for each element satisfies the conditions of:

6.0 wt. %≤X wt. %≤7.5 wt. %; and (i)

3.5 wt. %≤Y wt. %≤5.15 wt. %, where (ii)

X wt. %=aluminum+tin/3+zirconium/6+10*(oxygen+nitrogen+carbon), and

Y wt. %=aluminum+silicon*(zirconium+tin).

19 Claims, 4 Drawing Sheets

Increase in room temperature strength as X-values increase

Deterioration of room temperature ductility with increase in X-value

Enhanced creep resistance with increase in X-value

Higher elevated temperature strength with increase in Y-value

Loss of room temperature ductility with increase in Y-value

High temperature tensile strength (UTS) of inventive alloys and baseline/comparative alloy

BETA TITANIUM ALLOY SHEET FOR ELEVATED TEMPERATURE APPLICATIONS

FIELD

This disclosure relates generally to titanium alloys. More specifically, this disclosure relates to titanium alloys having a combination of properties including creep and oxidation resistance, in addition to tensile strength, at elevated temperatures while also being able to be produced in cold rolled sheet form.

BACKGROUND

The statements in this section merely provide background information related to the present disclosure and may not constitute prior art.

Titanium alloys are commonly used in aerospace applications due to their excellent strength to weight ratio and high temperature capability. Some commonly used titanium alloys for high temperature engine applications are near-alpha titanium alloys such as Ti-6242S (Ti-6Al-2Sn-4Zr-2Mo-0.1Si), Ti-1100 (Ti-6Al-2.7Sn-4Zr-0.4Mo-0.45Si) and Ti-834 (Ti-5.8Al-4Sn-0.7Nb-0.5Mo-0.3Si-0.006C). Although these alloys have excellent high temperature strength and creep resistance, it is very challenging to produce these alloys to sheets or strip form because of their inferior hot workability and limited cold rollability.

Due to increasing performance in aerospace applications, and especially aircraft turbojet engines with higher operating temperatures, new and improved titanium alloys that can meet the increasing mechanical and thermal requirements, while exhibiting good manufacturing characteristics, are continually desired.

SUMMARY

The present disclosure generally relates to a cold rollable beta titanium alloy having a combination of good tensile strength, creep and oxidation resistance at elevated temperatures (above about 1000° F. (538° C.)). The alloy consists essentially of, in weight percent, about 13.0 to about 20.0 molybdenum (Mo), about 2.0 to about 4.0 niobium (Nb), about 0.1 to about 0.4 silicon (Si), about 3.0 to about 5.0 aluminum (Al), up to about 3.0 zirconium (Zr), up to about 5.0 tin (Sn), up to about 0.25 oxygen (O), with a balance titanium (Ti) and other incidental impurities. Optional alloying elements may include, in weight percent, up to about 1.5 chromium (Cr) and up to about 2.0 tantalum (Ta), with a total of these optional alloying elements being less that about 3.0 weight percent (wt. %).

Additionally, the present disclosure relates to a cold rollable beta titanium alloy meeting the following conditions:

$$6.0 \text{ wt. } \% \leq X \text{ wt. } \% \leq 7.5 \text{ wt. } \% \quad \text{(i)}$$

$$3.5 \text{ wt. } \% \leq Y \text{ wt. } \% \leq 5.15 \text{ wt. } \% \quad \text{(ii)}$$

where: $X \text{ wt. } \% = Al+Sn/3+Zr/6+10*(O+N+C)$ $Y \text{ wt. } \% = Al+Si*(Zr+Sn)$ The alloys of the present disclosure are metastable beta (β-type) titanium alloys that can be strip or cold rolled to sheet gauges, among other stock forms, and exhibit excellent cold formability along with corrosion resistance in hydraulic fluids used for aircraft.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
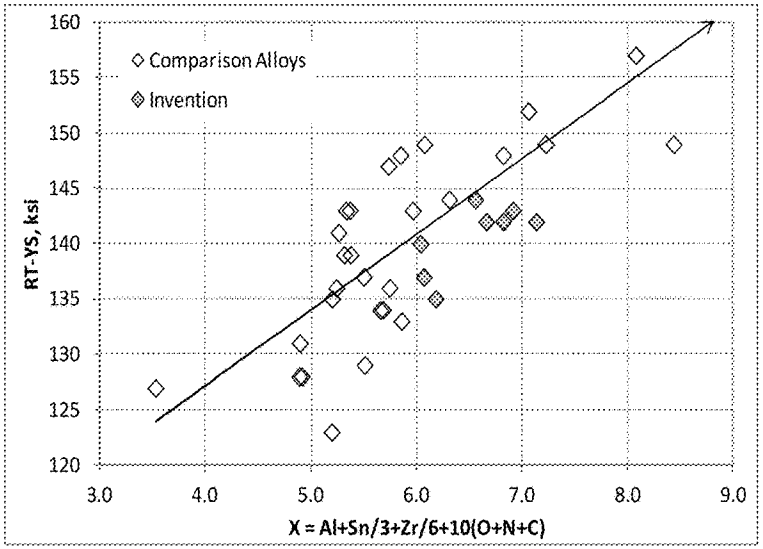
FIG. 1 is a graph of test data for beta titanium alloys according to the present disclosure compared to comparative alloys illustrating an increase in room temperature strength as the X-value of the equivalent alloy increases.

The following description is merely exemplary in nature and is in no way intended to limit the present disclosure or its application or uses. It should be understood that throughout the description, corresponding reference numerals indicate like or corresponding parts and features.

The present disclosure includes a cold rollable beta titanium alloy comprising molybdenum in an amount ranging between about 13.0 wt. % to about 20.0 wt. %, niobium in an amount ranging between about 2.0 wt. % to about 4.0 wt. %, silicon in an amount ranging between about 0.1 wt. % to about 0.4 wt. %, aluminum in an amount ranging between about 3.0 wt. % to about 5.0 wt. %, zirconium in an amount up to about 3.0 wt. %, tin in an amount up to about 5.0 wt. %, oxygen in an amount up to about 0.25 wt. %, and a balance of titanium and incidental impurities.

Optional alloying elements may be included, such as chromium in an amount up to about 1.5 wt. %, and tantalum in an amount up to about 2.0 wt. %. However, the total of chromium and tantalum is less than about 3.0 wt. %.

The titanium alloy according to the present disclosure satisfies the following conditions:

$$6.0 \text{ wt. } \% \leq X \text{ wt. } \% \leq 7.5 \text{ wt. } \% \quad \text{(i)}$$

$$3.5 \text{ wt. } \% \leq Y \text{ wt. } \% \leq 5.15 \text{ wt. } \% \quad \text{(ii)}$$

where: $X \text{ wt. } \% = Al+Sn/3+Zr/6+10*(O+N+C)$ $Y \text{ wt. } \% = Al+Si*(Zr+Sn)$ Each of the alloying elements and their criticality in achieving the desired mechanical properties and cold rollability is now described in greater detail:

Molybdenum

Molybdenum (Mo) is a beta stabilizing element that substantially increases high temperature strength and creep properties. A content greater than at least 10 wt. % is needed in a titanium alloy containing molybdenum to obtain 100% meta-stable beta phase at room temperature. Excess amounts of Mo will stabilize beta phase excessively resulting poor aging response that affects the overall properties of the alloy. It was therefore determined that the range for Mo content for this invention to be 13.0 to 20.0 wt. %.

Niobium

Niobium (Nb) is employed in the alloy of the present disclosure to further enhance oxide layer thickness reduction and resistance to the formation of an oxygen enriched zone. This effect of Nb in the invented alloy can generally be observed when its content is greater than 2.0 wt. %. Excessive amounts of Nb have adverse effects on elevated temperature strength and creep resistance of the alloy as the beta phase is stabilized. It is for this reason that the Nb content was determined to be 2.0 to 4.0 wt. %.

Silicon

Silicon (Si) is used in the present disclosure in order to develop a secondary silicide phase that impedes dislocation movement and thus improves creep strength. Silicon, generally present in solid solution as well as silicide dispersions, also has an influence on the tensile strength of the inventive alloy at elevated temperatures. Silicide particles are understood to progressively release silicon into the scales during long term exposure, which increases oxidation resistance with time. A combination of Al and Si will help reduce the thickness of the oxide layer by offering resistance to the formation of an oxygen diffusion zone. If the Si content is too low, the required effect in terms of oxidation, creep and elevated temperature tensile strength cannot be achieved. On the other hand, an increased Si content results in rapid reduction of ductility that adversely affects the cold formability. In this regard, the range for Si content for the alloys of the present disclosure is determined to be in the range of about 0.1 to about 0.4 wt %.

Aluminum

The alloy of the present disclosure contains aluminum higher than the baseline Ti-21S for the purpose of achieving greater strength and creep resistance at elevated temperatures. When the aluminum content is less than 3.0 wt. %, the effect of solution hardening is less pronounced, therefore the desired strength cannot be achieved. When the aluminum content exceeds 5.0 wt. %, resistance to hot formability is increased and cold workability is deteriorated, thereby causing difficulty in cold rollability. Frequent annealing is required to produce sheet gauge, which is not economical. Accordingly, the aluminum content of the present disclosure is in the range of about 3.0 to about 5.0 wt. % to suppress the deterioration of cold rollability while maintaining solution hardening effects.

Zirconium and Tin

Zirconium (Zr) and/or tin (Sn) are employed as alloying elements according to the teachings of the present disclosure, solely or in combination, by substituting a part of aluminum accordingly. In this case, one inventive alloy contains no more than about 3.0 wt. % of Zr and no more than about 5.0 wt. % of Sn and the value 'X' as indicated in Equation (i) above, ranges from about 6.0 to about 7.5 wt. %. A higher 'X' for the alloy of the present disclosure means a much higher strength alloy after aging by solid solutioning and/or alpha precipitates and/or silicide formation compared to the prior art (Ti-21S). "Ordering," a well known phenomenon in titanium alloys, is understood to occur at an aluminum equivalent of about 8 wt. %. This effectively limits the value 'X' to a maximum of about 7.5% wt. % to avoid ordering. Lower 'X' values (less than about 6.0 wt. %) do not provide the elevated temperature benefits of the present alloy compared to the prior art. The difference in aluminum equivalents between the alloy of the present disclosure and the prior art will also mean differences in strengthening capability between both the alloys.

Zirconium is known to form a continuous solid solution with titanium and in the alloy of the present disclosure improves the room temperature strength and enhances the creep strengthening, even with a solid solutioning mechanism or with the existence of silicon. Zirconium containing titanium alloys result in the formation of a complex compound of titanium-zirconium-silicon, $(TiZr)_5Si_3$ that benefits creep resistance. Tin may also be added by substituting aluminum since it further strengthens the beta matrix and alpha precipitates, resulting in an increase in tensile strength while maintaining ductility. However, excessive addition of tin will result in ductility losses, thereby affecting the cold workability.

Oxygen

Oxygen (O) in the present inventive alloy contributes to an increase in mechanical strength by constituting a solid solution, mainly in the alpha phase. While lower oxygen content does not contribute to the overall strength of the alloy, higher content will deteriorate room temperature ductility. Accordingly the oxygen content of the present disclosure should not exceed about 0.25 wt. %.

Optional Alloying Elements

Optional alloying elements other than those mentioned above may include Chromium (Cr) and Tantalum (Ta) in accordance with the teachings of the present disclosure. The use of each individual or any combination of these elements contributes to improvement in the properties as set forth above, and the total content of these alloying elements is limited to about 3.0 wt. %. Tantalum, in particular, may be considered as an alloying addition in lieu of Sn and by substituting parts of Al. Besides being beneficial for improving the elevated temperature properties such as strength and creep resistance of the alloy, Ta is effective in achieving enhanced oxidation resistance. However, excessive amounts of Ta may lead to melt related issues, such as segregation, thus affecting the overall properties of the alloy and increasing manufacturing costs. It has therefore been determined that tantalum content be limited to a maximum of about 2.0 wt. %. Similarly, the Cr content should be limited to a maximum of about 1.5 wt. % in accordance with the teachings of the present disclosure.

The following specific embodiments are given to illustrate the composition, properties, and use of titanium alloys prepared according to the teachings of the present disclosure and should not be construed to limit the scope of the disclosure. Those skilled in the art, in light of the present disclosure, will appreciate that many changes can be made in the specific embodiments which are disclosed herein and still obtain alike or similar result without departing from or exceeding the spirit or scope of the disclosure.

Mechanical property testing was performed and compared for titanium alloys prepared within the claimed compositional range, prepared outside of the claimed compositional range, and on conventional alloys either currently in use or potentially suitable for use. One skilled in the art will understand that any properties reported herein represent properties that are routinely measured and can be obtained by multiple different methods. The methods described herein represent one such method and other methods may be utilized without exceeding the scope of the present disclosure.

Example 1

Individual alloys were melted as 250 gm button ingots. These button ingots were converted to sheet by hot rolling to 0.15" (3.8 mm) thickness, conditioned and cold rolled by a 67% reduction to a thickness of 0.050" (1.27 mm). The cold rolling process was used as a preliminary indicator of the capability of various alloys for strip producibility. Those alloys that cracked during the conversion process were not evaluated further. The cold rolled sheets were subjected to a conventional beta solution anneal followed by duplex ageing at 1275° F./8 hr/air cool and 1200° F./8 hr/air cool. (691° C./8 hr/air cool and 649° C./8 hr/air cool). Coupons were cut from these sheets for ambient and elevated temperature tensile tests and creep testing.

Table 1 below includes the chemical composition of a series of button ingots that were melted. Mechanical properties including ambient, elevated temperature tensile and percentage strain measured during creep tests are shown in Table 2 below. All elevated temperature tensile tests were performed at 1000° F. (538° C.). Creep tests were conducted at 1000° F./20 ksi (538° C./138 MPa) for 50 hr and creep strain was measured.

As shown from the test results, alloys with "X" and "Y" values below the lower limit as indicated in Equations (i) and (ii) display inferior properties, including lower strength, than the targeted values. Higher Al content than the upper limit specified in the present disclosure, relates to high "X" values, thus deteriorating the room temperature ductility (and overall cold formability). The index "Y" is used for determining the chemical composition of the alloy to achieve improved properties. With "X" values within the specified limits, a low "Y" index results in inferior strength at elevated temperatures, and a high "Y" deteriorates cold formability. It is therefore desired to maintain a balance in the addition of alloying elements in accordance with the Equations (i) and (ii) set forth above.

As shown, alloys containing low Al without Zr or Sn (Alloy A5) have poor elevated temperature strength and creep resistance. Alloys with high Al content greater than the limit mentioned in the present disclosure (Alloys A24, A25, A26 etc.) deteriorates the ductility at room temperature, thereby affecting the overall cold formability. An elevated Nb level (Alloy A4) adversely affects the high temperature strength while degrading creep resistance. Also, due to the absence of other alloying elements to substitute for Al content, the alloy A4 fails to meet the targeted ambient temperature strength. Alloy A29 contains 2.0 wt. % Ta replacing Sn and substituting parts of Al, within the limits specified in this disclosure. It is noteworthy to mention that this alloy also exhibits an excellent balance of properties and confirms the benefit of Ta addition within the limits according to the teachings of the present disclosure.

TABLE 1

| | Mo | Al | Nb | Si | Sn | Zr | C | O | N | Others | X | Y | |
|---|---|---|---|---|---|---|---|---|---|---|---|---|---|
| | Range | | | | | | | | | | | | |
| | 13.0-20.0 | 3.0-5.0 | 2.0-4.0 | 0.1-0.4 | ≤5.0 | ≤3.0 | | ≤0.25 | | <3.0 | 6.0-7.5 | 3.50-5.15 | Comments |
| A1 | 19.3 | 3.12 | 2.84 | 0.19 | 0.02 | 0.00 | 0.01 | 0.21 | 0.004 | 0.000 | 5.37 | 3.12 | Comparison |
| A2 | 14.5 | 3.06 | 2.82 | 0.32 | 0.02 | 0.00 | 0.01 | 0.20 | 0.003 | 0.000 | 5.20 | 3.07 | Comparison |
| A3 | 14.7 | 3.06 | 2.85 | 0.47 | 0.02 | 0.00 | 0.01 | 0.23 | 0.003 | 0.000 | 5.50 | 3.07 | Comparison |
| A4 | 14.6 | 3.06 | 5.08 | 0.17 | 0.03 | 0.00 | 0.01 | 0.20 | 0.002 | 0.000 | 5.19 | 3.07 | Comparison |
| A5 | 14.7 | 1.15 | 2.65 | 0.21 | 0.02 | 0.00 | 0.01 | 0.22 | 0.007 | 0.000 | 3.53 | 1.15 | Comparison |
| A6 | 14.6 | 5.00 | 2.84 | 0.17 | 0.01 | 0.00 | 0.02 | 0.19 | 0.003 | 0.000 | 7.13 | 5.00 | Invention |
| A7 | 14.5 | 3.07 | 2.83 | 0.18 | 1.01 | 0.00 | 0.01 | 0.20 | 0.000 | 0.000 | 5.51 | 3.25 | Comparison |
| A8 | 14.6 | 3.08 | 2.85 | 0.17 | 3.01 | 0.00 | 0.01 | 0.19 | 0.010 | 0.000 | 6.18 | 3.59 | Invention |
| A9 | 14.5 | 3.10 | 2.83 | 0.18 | 4.93 | 0.00 | 0.01 | 0.20 | 0.007 | 0.000 | 6.91 | 3.99 | Invention |
| A10 | 14.4 | 3.07 | 2.83 | 0.18 | 0.06 | 0.00 | 0.07 | 0.24 | 0.012 | 0.000 | 6.31 | 3.08 | Comparison |
| A11 | 14.6 | 3.05 | 2.84 | 0.16 | 0.03 | 0.00 | 0.01 | 0.21 | 0.007 | 1.97 Cr | 5.33 | 3.05 | Comparison |
| A12 | 14.7 | 3.08 | 2.87 | 0.46 | 0.03 | 0.00 | 0.01 | 0.20 | 0.007 | 1.98 Cr | 5.26 | 3.09 | Comparison |
| A13 | 14.3 | 3.06 | 2.82 | 0.48 | 0.02 | 0.00 | 0.01 | 0.20 | 0.007 | 3.03 Cr | 5.24 | 3.07 | Comparison |
| A14 | 14.4 | 3.05 | 2.83 | 0.18 | 0.02 | 1.98 | 0.01 | 0.23 | 0.007 | 0.000 | 5.86 | 3.41 | Comparison |
| A15 | 14.4 | 3.05 | 2.83 | 0.45 | 0.02 | 1.97 | 0.01 | 0.21 | 0.007 | 0.000 | 5.66 | 3.95 | Comparison |
| A17 | 14.5 | 3.15 | 2.66 | 0.20 | 0.01 | 0.00 | 0.01 | 0.24 | 0.003 | 0.000 | 5.68 | 3.15 | Comparison |
| A18 | 14.4 | 3.10 | 2.54 | 0.21 | 0.01 | 0.00 | 0.02 | 0.24 | 0.003 | 0.000 | 5.73 | 3.10 | Comparison |
| A19 | 14.4 | 3.09 | 2.53 | 0.21 | 0.01 | 0.00 | 0.03 | 0.24 | 0.005 | 0.000 | 5.85 | 3.10 | Comparison |
| A20 | 14.5 | 3.12 | 2.64 | 0.34 | 0.01 | 0.00 | 0.01 | 0.25 | 0.002 | 0.000 | 5.74 | 3.12 | Comparison |
| A21 | 14.5 | 3.14 | 2.66 | 0.40 | 0.01 | 0.00 | 0.03 | 0.25 | 0.002 | 0.000 | 5.96 | 3.14 | Comparison |
| A22 | 14.5 | 3.13 | 2.64 | 0.45 | 0.01 | 0.00 | 0.02 | 0.27 | 0.004 | 0.000 | 6.07 | 3.13 | Comparison |
| A23 | 14.4 | 4.13 | 2.65 | 0.20 | 0.01 | 0.00 | 0.01 | 0.24 | 0.003 | 0.000 | 6.66 | 4.13 | Invention |
| A24 | 14.0 | 5.19 | 2.70 | 0.36 | 0.01 | 0.00 | 0.07 | 0.24 | 0.002 | 0.000 | 8.31 | 5.19 | Comparison |
| A25 | 13.9 | 5.11 | 2.68 | 0.35 | 5.06 | 0.00 | 0.08 | 0.22 | 0.003 | 0.000 | 9.83 | 6.88 | Comparison |
| A26 | 14.0 | 6.15 | 2.69 | 0.21 | 0.01 | 0.00 | 0.02 | 0.23 | 0.002 | 0.000 | 8.67 | 6.15 | Comparison |
| A27 | 15.5 | 3.10 | 2.69 | 0.22 | 0.02 | 0.00 | 0.02 | 0.19 | 0.011 | 0.000 | 5.31 | 3.10 | Comparison |
| A28 | 15.4 | 3.08 | 2.66 | 0.10 | 0.02 | 0.00 | 0.02 | 0.20 | 0.009 | 0.000 | 5.37 | 3.08 | Comparison |
| A29 | 15.5 | 3.10 | 2.64 | 0.31 | 0.00 | 0.00 | 0.02 | 0.20 | 0.007 | 2.0 Ta | 6.04 | 3.72 | Invention |
| A30 | 15.4 | 4.08 | 2.67 | 0.37 | 3.03 | 0.00 | 0.01 | 0.18 | 0.007 | 0.000 | 7.06 | 5.20 | Comparison |
| A31 | 15.4 | 4.07 | 2.61 | 0.22 | 0.02 | 3.00 | 0.02 | 0.17 | 0.008 | 0.000 | 6.56 | 4.73 | Invention |
| A33 | 15.3 | 4.56 | 2.63 | 0.38 | 2.02 | 0.00 | 0.02 | 0.16 | 0.019 | 0.000 | 7.22 | 5.33 | Comparison |
| A34 | 15.2 | 4.54 | 2.61 | 0.22 | 0.01 | 2.04 | 0.02 | 0.16 | 0.014 | 0.000 | 6.82 | 4.99 | Invention |
| A35 | 15.2 | 4.54 | 2.62 | 0.37 | 0.01 | 2.03 | 0.02 | 0.16 | 0.014 | 0.000 | 6.82 | 5.29 | Comparison |
| A36 | 15.2 | 4.06 | 2.61 | 0.37 | 0.01 | 0.01 | 0.01 | 0.18 | 0.010 | 0.000 | 6.07 | 4.07 | Invention |
| A37 | 15.2 | 5.07 | 2.60 | 0.22 | 0.01 | 3.00 | 0.02 | 0.22 | 0.010 | 0.000 | 8.07 | 5.73 | Comparison |
| A38 | 15.4 | 5.09 | 2.66 | 0.22 | 0.01 | 5.04 | 0.02 | 0.22 | 0.010 | 0.000 | 8.43 | 6.20 | Comparison |
| A39 | 15.4 | 6.08 | 2.70 | 0.38 | 0.01 | 0.00 | 0.02 | 0.17 | 0.009 | 0.000 | 8.07 | 6.08 | Comparison |

TABLE 1-continued

| | Mo | Al | Nb | Si | Sn | Zr | C | O | N | Others | X | Y | |
|---|---|---|---|---|---|---|---|---|---|---|---|---|---|
| | Range | | | | | | | | | | | | |
| | 13.0-20.0 | 3.0-5.0 | 2.0-4.0 | 0.1-0.4 | ≤5.0 | ≤3.0 | | ≤0.25 | | <3.0 | 6.0-7.5 | 3.50-5.15 | Comments |
| A40 | 15.4 | 3.10 | 2.66 | 0.22 | 0.02 | 0.00 | 0.02 | 0.16 | 0.009 | 0.000 | 4.91 | 3.10 | Comparison |
| A41 | 15.6 | 3.13 | 2.66 | 0.22 | 0.01 | 0.00 | 0.02 | 0.15 | 0.010 | 0.000 | 4.89 | 3.13 | Comparison |
| A42 | 15.6 | 3.12 | 2.70 | 0.23 | 0.01 | 0.00 | 0.02 | 0.15 | 0.009 | 0.000 | 4.88 | 3.12 | Comparison |

X = Al + (Sn/3) + (Zr/6) + 10(O + N + C)
Y = Al + Si * (Zr + Sn)

TABLE 2

| | | Room Temperature Properties | | | Elevated Temperature Properties | | | | |
|---|---|---|---|---|---|---|---|---|---|
| Target | Remarks | YS, ksi (MPa) ≥135 (930) | UTS, ksi (MPa) ≥145 (1000) | EI % ≥7.0 | YS, ksi (MPa) ≥80 (551) | UTS, ksi (MPa) ≥90 (620) | EI, % | Creep, % ≤1.00 | Comments |
| A1 | Comparison | 143 (986) | 153 (1055) | 10 | 86 (593) | 97 (669) | 18 | 1.21 | Poor Creep |
| A2 | Comparison | 135 (931) | 146 (1007) | 13 | 75 (517) | 90 (620) | 16 | 0.95 | Low ET Strength |
| A3 | Comparison | 137 (945) | 148 (1020) | 9 | 75 (517) | 90 (620) | 17 | 1.27 | Poor Creep, Low ET Strength |
| A4 | Comparison | 123 (848) | 134 (924) | 14 | 69 (476) | 78 (538) | 24 | 1.51 | Poor Creep, Low RT & ET Strength |
| A5 | Comparison | 127 (876) | 135 (931) | 9 | 58 (400) | 71 (489) | 18 | 2.92 | Poor Creep, Low RT & ET Strength |
| A6 | Invention | 142 (979) | 155 (1069) | 15 | 91 (627) | 109 (751) | 15 | 0.59 | Invention |
| A7 | Comparison | 129 (889) | 140 (965) | 15 | 78 (538) | 93 (641) | 27 | 1.29 | Poor Creep, Low RT & ET Strength |
| A8 | Invention | 135 (931) | 145 (1000) | 11 | 80 (552) | 94 (648) | 17 | 1.00 | Invention |
| A9 | Invention | 143 (986) | 153 (1055) | 10 | 91 (627) | 108 (745) | 18 | 0.80 | Invention |
| A10 | Comparison | 144 (993) | 155 (1069) | 14 | 79 (545) | 94 (648) | 24 | 1.05 | Poor Creep, Low ET Strength |
| A11 | Comparison | 143 (986) | 155 (1069) | 12 | 86 (593) | 88 (607) | 23 | 2.37 | Poor Creep, Low ET Strength |
| A12 | Comparison | 141 (972) | 153 (1055) | 10 | 77 (531) | 89 (614) | 40 | 2.93 | Poor Creep, Low ET Strength |
| A13 | Comparison | 136 (938) | 148 (1020) | 9 | 79 (545) | 90 (620) | 40 | 5.31 | Poor Creep, Low ET Strength |
| A14 | Comparison | 133 (917) | 144 (993) | 11 | 72 (496) | 88 (607) | 18 | 0.91 | Low RT & ET strength |
| A15 | Comparison | 134 (924) | 145 (1000) | 3 | 72 (496) | 86 (593) | 20 | 1.26 | Poor Creep, Low RT Strength & EI |
| A17 | Comparison | 134 (924) | 146 (1007) | 18 | 74 (510) | 84 (579) | 25 | 0.97 | Low RT & ET strength |
| A18 | Comparison | 147 (1013) | 158 (1098) | 11 | 77 (531) | 93 (641) | 29 | 1.18 | Poor Creep, Low ET Strength |
| A19 | Comparison | 148 (1020) | 159 (1096) | 8 | 79 (545) | 91 (627) | 12 | 1.10 | Poor Creep, Low ET Strength |
| A20 | Comparison | 136 (938) | 145 (1000) | 5 | 77 (531) | 89 (614) | 20 | 0.91 | Low RT-EI, Low ET strength |
| A21 | Comparison | 143 (986) | 154 (1062) | 6 | 75 (517) | 88 (607) | 19 | 1.26 | Low RT-EI, Poor Creep, Low ET Strength |
| A22 | Comparison | 149 (1027) | 162 (1117) | 6 | 79 (545) | 91 (627) | 21 | 1.23 | Low RT-EI, Poor Creep, Low ET Strength |
| A23 | Invention | 142 (979) | 154 (1062) | 9 | 84 (579) | 96 (662) | 18 | 0.68 | Invention |
| A24 | Comparison | | | Broken during conversion | | | | | Poor Cold Formability |
| A25 | Comparison | | | Broken during conversion | | | | | Poor Cold Formability |
| A26 | Comparison | | | Broken during conversion | | | | | Poor Cold Formability |
| A27 | Comparison | 139 (958) | 149 (1027) | 8 | 77 (531) | 90 (620) | 25 | 1.22 | Poor Creep, Low ET Strength |
| A28 | Comparison | 139 (958) | 150 (1034) | 12 | 73 (503) | 87 (599) | 24 | 1.60 | Poor Creep, Low ET Strength |
| A29 | Invention | 140 (965) | 150 (1034) | 12 | 80 (552) | 94 (648) | 20 | 0.92 | Invention |
| A30 | Comparison | 152 (1048) | 157 (1082) | 3 | 94 (648) | 111 (765) | 16 | 0.73 | Low RT-EI |
| A31 | Invention | 144 (993) | 154 (1062) | 8 | 87 (600) | 102 (703) | 21 | 0.68 | Invention |
| A33 | Comparison | 149 (1027) | 153 (1055) | 2 | 98 (676) | 115 (793) | 23 | 0.49 | Low RT-EI |
| A34 | Invention | 142 (979) | 153 (1055) | 13 | 88 (607) | 103 (710) | 17 | 0.41 | Invention |
| A35 | Comparison | 148 (1020) | 152 (1048) | 2 | 90 (621) | 106 (731) | 19 | 0.73 | Low RT-EI |
| A36 | Invention | 137 (945) | 149 (1027) | 12 | 83 (572) | 98 (676) | 14 | 0.61 | Invention |
| A37 | Comparison | 157 (1082) | 168 (1158) | 4 | 102 (703) | 121 (834) | 13 | 0.53 | Low RT-EI |
| A38 | Comparison | 149 (1027) | 149 (1027) | 0 | 94 (648) | 115 (793) | 23 | 0.80 | Low RT-EI |
| A39 | Comparison | 157 (1082) | 165 (1138) | 2 | 104 (717) | 127 (876) | 18 | 0.40 | Low RT-EI |
| A40 | Comparison | 128 (882) | 138 (951) | 17 | 71 (489) | 88 (607) | 22 | 1.25 | Poor Creep, Low RT & ET Strength |
| A41 | Comparison | 131 (903) | 140 (965) | 15 | 70 (483) | 83 (572) | 12 | 1.40 | Poor Creep, Low RT & ET Strength |
| A42 | Comparison | 128 (882) | 138 (951) | 15 | 69 (476) | 82 (565) | 25 | 1.48 | Poor Creep, Low RT & ET Strength |

All Elevated Temperature Tests at 1000 F. (537.8 C.)
Creep test condition: 1000 F./20 ksi/50 hr (537.8 C./137.9 MPa/50 hr)

While Tables 1 and 2 present the chemical composition and the mechanical properties respectively, for the button alloys, Table 3 below provides a summary of each alloy, with a "P" indicating that the particular property/value confers to the desired target and an "F" indicating out of limits for the corresponding alloy:

TABLE 3

| | | | RT Properties | | | ET Properties at 1000 F. | | | |
|---|---|---|---|---|---|---|---|---|---|
| Alloy | 6 ≤ X-value ≤ 7.5 | 3.5 ≤ Y-index ≤ 5.15 | YS ≥ 135 ksi | UTS ≥ 145 ksi | EI ≥ 7.0% | YS ≥ 80 ksi | UTS ≥ 90 ksi | Creep ≤ 1.0% | Conclusion |
| A1 | F | F | P | P | P | P | P | F | Comparison |
| A2 | F | F | P | P | P | F | P | P | Comparison |
| A3 | F | F | P | P | P | F | P | F | Comparison |
| A4 | F | F | F | F | P | F | F | F | Comparison |
| A5 | F | F | F | F | P | F | F | F | Comparison |
| A6 | P | P | P | P | P | P | P | P | Invention |
| A7 | F | F | F | F | P | F | P | F | Comparison |
| A8 | P | P | P | P | P | P | P | F | Invention |
| A9 | P | P | P | P | P | P | P | P | Invention |
| A10 | P | F | P | P | P | F | P | F | Comparison |
| A11 | F | F | P | P | P | P | F | F | Comparison |
| A12 | F | F | P | P | P | F | F | F | Comparison |
| A13 | F | F | P | P | P | F | P | F | Comparison |
| A14 | F | F | F | F | P | F | F | P | Comparison |
| A15 | F | P | F | P | F | F | F | F | Comparison |
| A17 | F | F | F | P | P | F | F | P | Comparison |
| A18 | F | F | P | P | P | F | P | F | Comparison |
| A19 | F | F | P | P | P | F | P | F | Comparison |
| A20 | F | F | P | P | F | F | F | P | Comparison |
| A21 | F | F | P | P | F | F | F | F | Comparison |
| A22 | P | F | P | P | F | F | P | F | Comparison |
| A23 | P | P | P | P | P | P | P | P | Invention |
| A24 | F | F | F | F | F | F | F | P | Comparison |
| A25 | F | F | F | F | F | F | F | P | Comparison |
| A26 | F | F | F | F | F | F | F | P | Comparison |
| A27 | F | F | P | P | P | F | P | F | Comparison |
| A28 | F | F | P | P | P | F | F | F | Comparison |
| A29 | P | P | P | P | P | P | P | P | Invention |
| A30 | P | F | P | P | F | P | P | P | Comparison |
| A31 | P | P | P | P | P | P | P | P | Invention |
| A33 | P | F | P | P | F | P | P | P | Comparison |
| A34 | P | P | P | P | P | P | P | P | Invention |
| A35 | P | F | P | P | F | P | P | P | Comparison |
| A36 | P | P | P | P | P | P | P | P | Invention |
| A37 | F | F | P | P | F | P | P | P | Comparison |
| A38 | F | F | P | P | F | P | P | P | Comparison |
| A39 | F | F | P | P | F | P | P | P | Comparison |
| A40 | F | F | F | F | P | F | F | F | Comparison |
| A41 | F | F | F | F | P | F | F | F | Comparison |
| A42 | F | F | F | F | P | F | F | F | Comparison |

Figure 2:
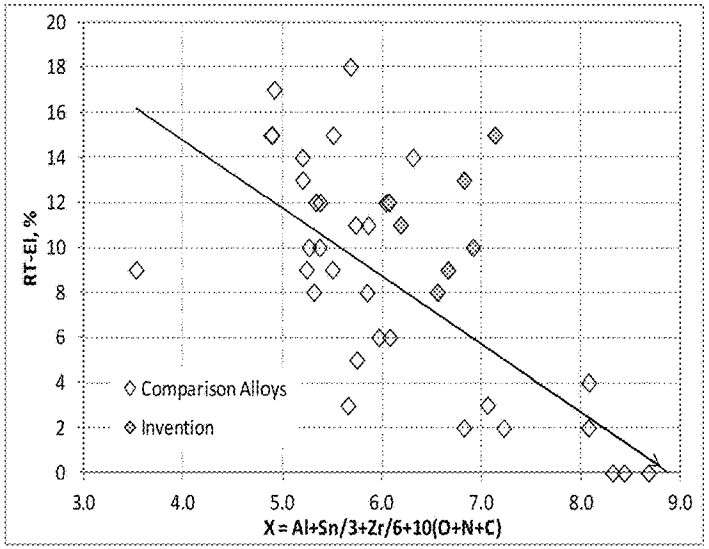
FIG. 2 is a graph of test data for beta titanium alloys according to the present disclosure compared to comparative alloys illustrating a deterioration of room temperature ductility as the X-value of the equivalent alloy increases.
Figure 3:
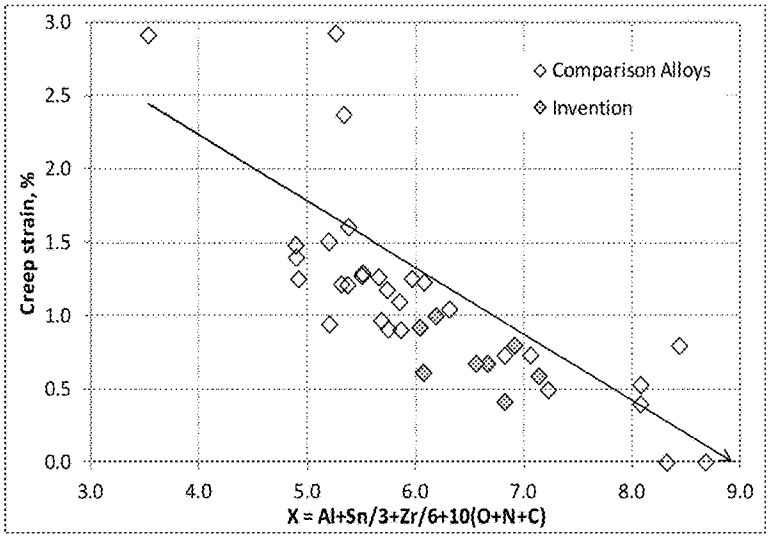
FIG. 3 is a graph of test data for beta titanium alloys according to the present disclosure compared to comparative alloys illustrating enhanced creep resistance as the X-value of the equivalent alloy increases.
Figure 4:
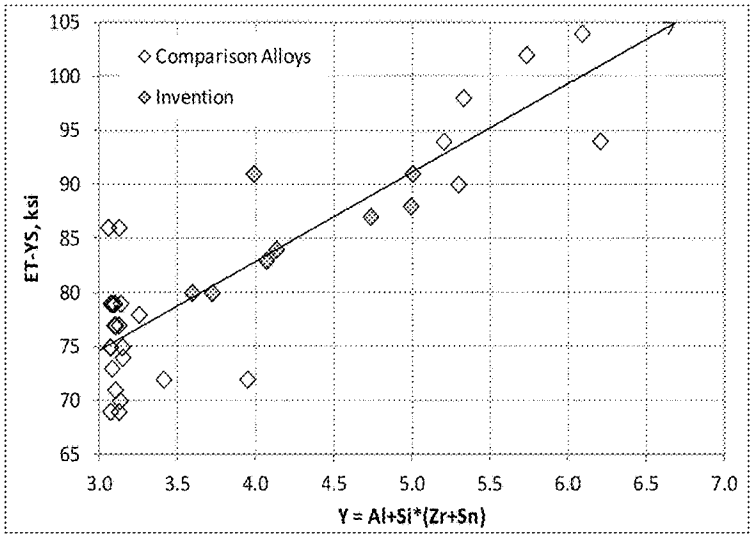
FIG. 4 is a graph of test data for beta titanium alloys according to the present disclosure compared to comparative alloys illustrating higher elevated temperature strength as the Y-value of the equivalent alloy increases.
Figure 5:
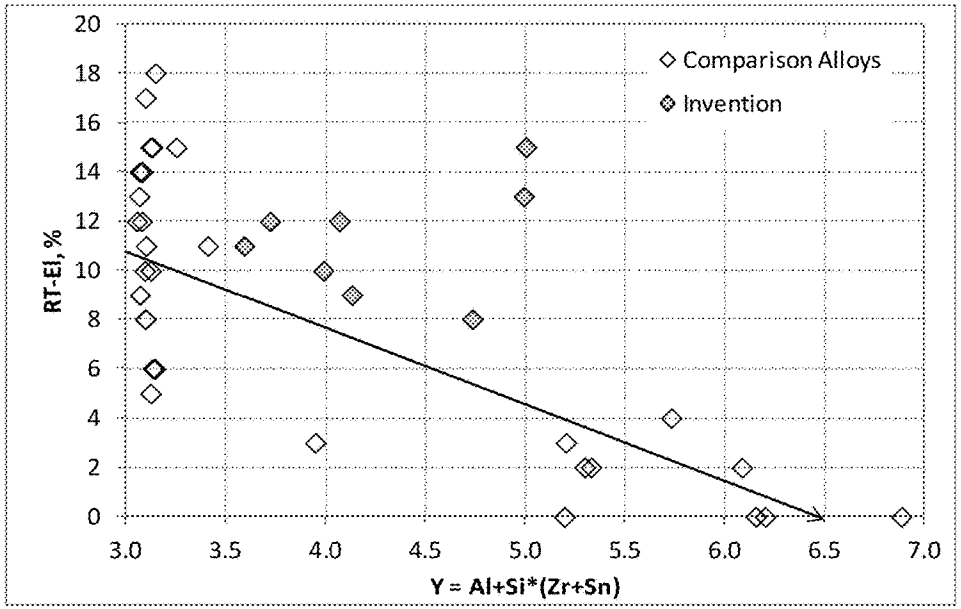
FIG. 5 is a graph of test data for beta titanium alloys according to the present disclosure compared to comparative alloys illustrating a loss of room temperature ductility as the Y-value of the equivalent alloy increases.

Referring now to the figures, FIGS. 1 through 3 present the effect of the "X" value on room temperature yield strength, elongation, and the creep strain observed on the button alloys. As evident from the trends depicted in the respective figures, it can be noted that a low "X" value relates to low strength, and an increase in the "X" value subsequently increases strength, however at the compromise of the room temperature ductility. Also, significant improvements in the creep resistance of the button alloys with an increase in "X" values can be observed from FIG. 3. Similarly, FIGS. 4 and 5 show that an increase in the "Y" index also relates to an increase in elevated temperature strength, but a corresponding loss in room temperature ductility respectively, for the button alloys.

In summary, it is to be understood that "X" and "Y" values higher than the limits according to the present disclosure, lead to an increase in strength and improvement of creep resistance, however, the cold formability of the alloy deteriorates considerably. On the other hand, low values of "X" and "Y" other than those according to the present disclosure, do not achieve the required target properties.

Example 2

Four alloy ingots, each about 38 lb (17 kg) were made using a laboratory VAR (Vacuum Arc Remelting) furnace. The ingots were 8" (200 mm) diameter and produced using a double VAR process. Chemical compositions of these ingots are shown in Table 4 below. The ingots were forged to 1.5" (3.8 cm) thick plates, followed by hot rolling to 0.15" (3.8 mm) thick plates. After conditioning to remove the alpha case and the scale, these plates were then cold rolled to 0.060" (1.5 mm) followed by solution anneal and duplex ageing. Various tests were performed on the sheets to verify the superiority in properties of the alloy of the present disclosure compared to the baseline Ti-21S alloy.

TABLE 4

| | Mo | Al | Nb | Si | Sn | Zr | C | O | N | Others | X, wt % | Y, wt % | |
|---|---|---|---|---|---|---|---|---|---|---|---|---|---|
| | Range | | | | | | | | | | | | |
| | 13.0-20.0 | 3.0-5.0 | 2.0-4.0 | 0.1-0.4 | ≤5.0 | ≤3.0 | | ≤0.25 | | <3.0 | 6.0-7.5 | 3.50-5.15 | Remarks |
| V1 | 16.2 | 4.60 | 2.83 | 0.23 | 0.016 | 1.48 | 0.009 | 0.15 | 0.007 | 0.000 | 6.51 | 4.94 | Invention |
| V2 | 16.2 | 4.67 | 2.85 | 0.24 | 0.017 | 1.89 | 0.015 | 0.15 | 0.008 | 0.000 | 6.72 | 5.13 | Invention |
| V3 | 16.0 | 4.58 | 2.79 | 0.23 | 0.017 | 2.27 | 0.013 | 0.15 | 0.009 | 0.000 | 6.68 | 5.11 | Invention |
| V4 | 15.8 | 4.59 | 2.76 | 0.35 | 0.000 | 0.00 | 0.012 | 0.16 | 0.010 | 2.0 Ta | 7.08 | 5.29 | Comparison |
| Prod. Heat | 15.5 | 2.84 | 2.71 | 0.20 | 0.015 | 0.00 | 0.022 | 0.12 | 0.001 | 0.000 | 4.28 | 2.84 | Comparison |

Results of evaluation from these sheets as set forth above are shown in

TABLE 5

| | | Room Temperature Properties | | | Elevated Temperature Properties | | | | |
|---|---|---|---|---|---|---|---|---|---|
| Target | Comments | YS, ksi (MPa) ≥135 (930) | UTS, ksi (MPa) ≥145 (1000) | EI % ≥7.0 | YS, ksi (MPa) ≥80 (551) | UTS, ksi (MPa) ≥90 (620) | EI % | Creep, % ≤1.0 | Remarks |
| V1 | Invention | 148 (1022) | 161 (1109) | 7.8 | 90 (620) | 102 (703) | 14 | 0.34 | Invention |
| V2 | Invention | 150 (1036) | 162 (1120) | 7.2 | 85 (586) | 94 (648) | 13 | 0.46 | Invention |
| V3 | Invention | 149 (1027) | 161 (1107) | 9.2 | 98 (676) | 112 (772) | 14 | 0.31 | Invention |
| V4 | Comparison | 155 (1069) | 165 (1141) | 4.1 | 87 (596) | 97 (667) | 13 | 0.42 | Low RT-EI |
| Prod. Heat | Comparison | 131 (903) | 141 (972) | 22.0 | 73 (503) | 82 (565) | 48 | 1.70 | Low RT, ET strength, Poor Creep |

All Elevated Temperature Tests at 1000 F. (537.8 C.)
Creep test condition: 1000 F./20 ksi/50 hr (537.8 C./137.9 MPa/50 hr)

A noticeable increase in the room temperature strength (about 13~15%) for the alloys according to the present disclosure was observed when compared to the baseline Ti-21S alloy (production heat). As set forth above in Equation (ii), the "Y" index of Alloy V4 exceeds the specified limit that reflects in lower room temperature elongation, thereby affecting the cold workability.

Figure 6:
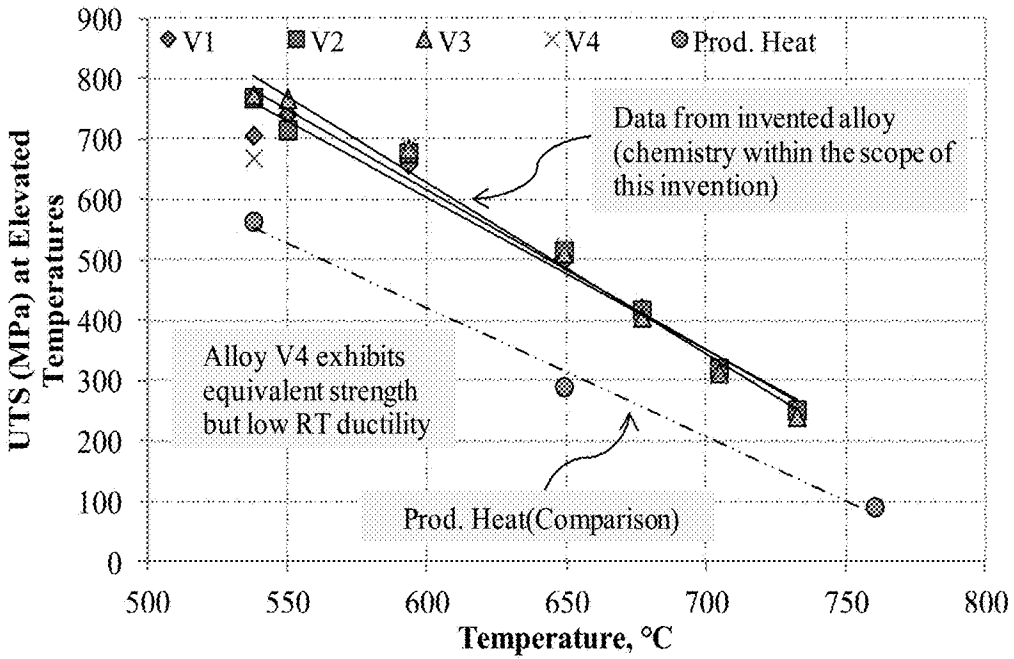
FIG. 6 is a graph of test data illustrating the high temperature tensile strength (ultimate tensile strength or UTS) compared with an alloy V4 as shown in Table 4.

Elevated temperature strength at various temperatures for the four alloy sheets along with the production heat (Ti-21S) is shown below in Table 6 and graphically represented in FIG. 6. As demonstrated, the alloys of present disclosure provide about 80~130° F. (or 44~72° C.) advantage over the baseline Ti-21S, over the range of test temperatures. Although the Alloy V4 exhibits equivalent strength as others in the present disclosure, it is to be noted that Alloy V4 exceeds the index "Y" specified in Equation (ii) above and thus has deteriorated ductility at room temperature.

TABLE 7

| Alloy | Larson-Miller Parameter (0.2%) | Remarks |
|---|---|---|
| V1 | 31.53 | Invention |
| V2 | 31.12 | Invention |
| V3 | 31.67 | Invention |
| V4 | 31.31 | Comparison |
| Prod. Heat (Ti—21S) | 30.12 | Comparison |
| Prod. Heat (Ti—6242S) | 31.39 | Comparison |

Note:
Larson Miller Parameter = $[(492 + T)*(20 + \log_{10}t)/1000]$, where 'T' is temperature in ° F. and 't' is time in hrs., respectively.

Oxidation Testing

Weighed coupons from the sheets produced using the compositions shown in Table 4 were exposed to air at temperatures of 1200° F. (649° C.) and 1400° F. (760° C.) for 200 hours. The specimens were weighed again after the test and the weight gain was calculated based on the area of specimen exposed. This weight gain (mg/cm$^2$) is used as the criterion for determining oxidation resistance. As shown in Table 8 below, slightly higher weight gain for the alloys of

TABLE 6

| | | Elevated temperature UTS, ksi (MPa) of the invented alloy sheets | | | | |
|---|---|---|---|---|---|---|
| Ingot | Remarks | 1000° F. (537.8° C.) | 1100° F. (593.3° C.) | 1200° F. (648.9° C.) | 1300° F. (704.4° C.) | 1400° F. (760° C.) |
| V1 | Invention | 102 (703) | 96 (662) | 68 (469) | 42 (289) | |
| V2 | Invention | 111 (765) | 98 (676) | 71 (489) | 42 (289) | |
| V3 | Invention | 112 (772) | 99 (682) | 71 (489) | 42 (289) | |
| V4 | Comparison | 97 (669) | 100 (689) | 76 (524) | 45 (310) | |
| Prod. Heat | Comparison | 82 (565) | | 42 (289) | | 13 (90) |

As shown below in Table 7, the Larson Miller Parameter for the alloys of the present disclosure almost falls within the range of a near alpha titanium alloy such as Ti-6242S at the tested temperatures, exhibiting exceptional creep resistance for a beta titanium alloy:

the present disclosure at low temperature (such as 1200° F. or 649° C.) is noted, but lower weight gain at high temperatures (>1200° F. or 649° C.) demonstrates the ability of the alloy to be used for elevated temperature applications.

TABLE 8

| Alloy | Weight Gain ($mg/cm^2$) 1200° F. (649° C.)/200 hr | 1400° F. (760° C.)/200 hr | Remarks |
|---|---|---|---|
| V1 | 0.925 | 1.860 | Invented |
| V2 | 0.982 | 1.020 | Invented |
| V3 | 1.139 | 2.135 | Invented |
| V4 | 0.620 | 1.198 | Comparison |
| Prod. Heat (Ti—21S) | 0.576 | 2.165 | Comparison |
| Prod. Heat (Ti—6242S) | 0.453 | 4.629 | Comparison |

Additional oxidation tests were performed in a thermo gravimetric analysis (TGA) unit, wherein the samples were exposed to air in a temperature range of 1000° F. to 1500° F. (538° C. to 816° C.) for 200 hours. Samples from the alloy V1 (as mentioned in Table 4) and production scale Ti-21S were used for this experimental purpose. Results, shown in Table 9 below, indicate a similar trend as observed in the oxidation studies mentioned above. The oxidation weight gain ($mg/cm^2$) of the inventive alloy is slightly higher than the standard Ti-21S at the lower temperatures, however, lower weight gain measurements were recorded for the inventive alloy at temperatures greater than 1200° F. (649° C.).

TABLE 9

| | 1000° F. (538° C.) | 1100° F. (593° C.) | 1200° F. (649° C.) | 1300° F. (704° C.) | 1400° F. (760° C.) | 1500° F. (816° C.) |
|---|---|---|---|---|---|---|
| Alloy V1 | 0.309 | 0.488 | 0.975 | 1.311 | 1.929 | 4.927 |
| Prod. Heat Ti-21S | 0.200 | 0.464 | 0.806 | 1.350 | 2.255 | 5.979 |

Accordingly, the alloy properties of the present disclosure achieve at least 10% higher minimum room temperature strength and elongation than the Ti-21S alloy, subjected to solution anneal and duplex aging (AMS 4897). Additionally, the high temperature strength and creep properties of the alloys of the present disclosure provide about 100° F. (55° C.) improvement in service temperatures over the baseline Ti-21S alloy. Further, alloys of the present disclosure exhibited significantly lower weight gain compared to the baseline Ti-21S alloy when subjected to oxidation tests at elevated temperatures (above about 1200° F. or 649° C.) for about 200 hours. The present inventive alloy thus delivers a strip producible beta titanium alloy with high strength at room temperature and excellent elevated temperature properties such as creep and oxidation resistance.

Cold rolling, or processing alloy stock below its recrystallization temperature, may be performed with a variety of stock forms, such as strip, coil sheet, bar, or rod by way of example. The cold rolling process may be continuous, or discontinuous, and reduction of the stock through the cold rolling process is between about 20% and about 90%. In one form of the present disclosure, cold rolling is performed with a continuous strip coil process.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide illustrations of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A beta titanium alloy comprising:

molybdenum in an amount ranging between about 13.0 wt. % to about 20.0 wt. %;

niobium in an amount ranging between about 2.0 wt. % to about 4.0 wt. %;

silicon in an amount ranging between about 0.1 wt. % to about 0.4 wt. %;

aluminum in an amount ranging between about 3.0 wt. % to about 5.0 wt. %;

zirconium in an amount greater than 0.0% and up to about 3.0 wt. %;

tin in an amount greater than 0.0% and up to about 5.0 wt. %;

oxygen greater than 0.0% and in an amount up to about 0.25 wt. %; and a balance of titanium and incidental impurities, wherein the beta titanium alloy is cold rollable.

2. The beta titanium alloy according to claim 1 further comprising chromium greater than 0.0% and in an amount up to about 1.5 wt. %.

3. The beta titanium alloy according to claim 1 further comprising tantalum greater than 0.0% and in an amount up to about 2.0 wt. %.

4. The beta titanium alloy according to claim 1 further comprising chromium greater than 0.0% and in an amount up to about 1.5 wt. % and tantalum greater than 0.0% and in an amount up to about 2.0 wt. %, wherein the total of chromium and tantalum is less than about 3.0 wt. %.

5. The beta titanium alloy according to claim 1 comprising an average room temperature yield strength of about 135 ksi (930 MPa) and an ultimate tensile strength of about 145 ksi (1000 MPa) with at least 7% elongation.

6. The beta titanium alloy according to claim 1 comprising a yield strength of at least 80 ksi (551 MPa) and an ultimate tensile strength of about 90 ksi (620 MPa) at an elevated temperature of about 1000° F. (538° C.).

7. The beta titanium alloy according to claim 1 comprising a total strain of no more than about 1.0% after a creep test at 1000° F./20 ksi/50 hrs (538° C./138 MPa/50 hrs).

8. A part formed from the titanium alloy according to claim 1.

9. A cold rolled alloy product comprising:
molybdenum in an amount ranging between about 13.0 wt. % to about 20.0 wt. %;
niobium in an amount ranging between about 2.0 wt. % to about 4.0 wt. %;
silicon in an amount ranging between about 0.1 wt. % to about 0.4 wt. %;
aluminum in an amount ranging between about 3.0 wt. % to about 5.0 wt. %;
zirconium greater than 0.0% and in an amount up to about 3.0 wt. %;
tin greater than 0.0% and in an amount up to about 5.0 wt. %;
oxygen greater than 0.0% and in an amount up to about 0.25 wt. %; and
a balance of titanium and incidental impurities.

10. The cold rolled alloy product according to claim 9 further comprising chromium greater than 0.0% and in an amount up to about 1.5 wt. %.

11. The cold rolled alloy product according to claim 9 further comprising tantalum greater than 0.0% and in an amount up to about 2.0 wt. %.

12. The cold rolled alloy product according to claim 9 further comprising chromium greater than 0.0% and in an amount up to about 1.5 wt. % and tantalum greater than 0.0% and in an amount up to about 2.0 wt. %, wherein the total of chromium and tantalum is less than about 3.0 wt. %.

13. The cold rolled alloy product according to claim 9 comprising an average room temperature yield strength of about 135 ksi (930 MPa) and an ultimate tensile strength of about 145 ksi (1000 MPa) with at least 7% elongation.

14. The cold rolled alloy product according to claim 9 comprising a yield strength of at least 80 ksi (551 MPa) and an ultimate tensile strength of about 90 ksi (620 MPa) at an elevated temperature of about 1000° F. (538° C.).

15. The cold rolled alloy product according to claim 9 comprising a total strain of no more than about 1.0% after a creep test at 1000° F./20 ksi/50 hrs (538° C./138 MPa/50 hrs).

16. The cold rolled alloy product according to claim 9, wherein the product is in the form of one of a strip, a sheet, a bar, and a rod.

17. A part formed from the cold rolled alloy product according to claim 9.

18. A beta titanium alloy comprising:
molybdenum in an amount ranging between about 13.0 wt. % to about 20.0 wt. %;
niobium in an amount ranging between about 2.0 wt. % to about 4.0 wt. %;
silicon in an amount ranging between about 0.1 wt. % to about 0.4 wt. %;
aluminum in an amount ranging between about 3.0 wt. % to about 5.0 wt. %;
at least one of:
zirconium greater than 0.0% and in an amount up to about 3.0 wt. %; and
tin greater than 0.0% and in an amount up to about 5.0 wt. %;
oxygen greater than 0.0% and in an amount up to about 0.25 wt. %; and
a balance of titanium and incidental impurities,
wherein the beta titanium alloy is cold rollable and the ranges for each element satisfies the conditions of:

$$6.0 \text{ wt. } \% \leq X \text{ wt. } \% \leq 7.5 \text{ wt. } \% \quad \text{(i)}$$

$$3.5 \text{ wt. } \% \leq Y \text{ wt. } \% \leq 5.15 \text{ wt. } \% \quad \text{(ii)}$$

where: X wt. %=aluminum+tin/3+zirconium/6+10*(oxygen+nitrogen+carbon), and

Y wt. %=aluminum+silicon*(zirconium+tin)

19. A beta titanium alloy comprising:
an average room temperature yield strength of about 135 ksi (930 MPa);
an ultimate tensile strength of about 145 ksi (1000 MPa);
at least 7% elongation;
a yield strength of at least 80 ksi (551 MPa) and an ultimate tensile strength of at least 90 ksi (620 MPa) at 1,000° F. (538° C.); and
a total strain of no more than 1.0% at 1000° F./20 ksi/50 hr (538° C./138 MPa/50 hr),
wherein the alloy is cold rollable and satisfies the conditions of:

$$6.0 \text{ wt. } \% \leq X \text{ wt. } \% \leq 7.5 \text{ wt. } \%; \text{ and} \quad \text{(i)}$$

$$3.5 \text{ wt. } \% \leq Y \text{ wt. } \% \leq 5.15 \text{ wt. } \%, \text{ where} \quad \text{(ii)}$$

X wt. %=aluminum+tin/3+zirconium/6+10*(oxygen+nitrogen+carbon), and

Y wt. %=aluminum+silicon*(zirconium+tin).

* * * * *